US006600429B2

(12) United States Patent
Zander

(10) Patent No.: US 6,600,429 B2
(45) Date of Patent: Jul. 29, 2003

(54) BLOCK SIGNAL AND TRAIN PROXIMITY DETECTOR

(76) Inventor: Dennis Zander, 35 Rolling Meadows, Penfield, NY (US) 14526

( * ) Notice: Subject to any disclaimer, the term of this patent is extended or adjusted under 35 U.S.C. 154(b) by 0 days.

(21) Appl. No.: 09/826,654

(22) Filed: Apr. 5, 2001

(65) Prior Publication Data

US 2002/0147565 A1 Oct. 10, 2002

(51) Int. Cl.[7] ..... G08G 1/07
(52) U.S. Cl. ..... 340/917
(58) Field of Search ..... 702/150; 246/220, 246/476, 187; 324/178; 73/290; 198/750; 340/933, 519; 105/26.05; 318/580; 178/17.5

(56) References Cited

U.S. PATENT DOCUMENTS 3,964,704 A 6/1976 Karr
4,064,508 A * 12/1977 Simon ..... 340/519
4,352,064 A * 9/1982 Dunn ..... 324/178
4,369,943 A 1/1983 Hussein
4,498,650 A 2/1985 Smith et al.
4,613,103 A * 9/1986 Waranowitz ..... 246/473 A
5,502,367 A 3/1996 Jones
5,864,304 A 1/1999 Gerszberg et al.
6,014,934 A * 1/2000 Pierson ..... 105/26.05
6,025,789 A * 2/2000 Lane et al. ..... 340/933
6,296,208 B1 * 10/2001 Franke ..... 246/220
6,320,346 B1 * 11/2001 Graf ..... 318/580

FOREIGN PATENT DOCUMENTS

JP 404247599 A * 9/1992 ..... G09G/1/04

* cited by examiner

*Primary Examiner*—John Barlow
*Assistant Examiner*—Tung Lau
(74) *Attorney, Agent, or Firm*—Stephen B. Salai, Esq.; Brian B. Shaw, Esq.; Harter, Secrest & Emery LLP

(57) ABSTRACT

A combination model train sensor and block signal includes a train proximity sensor, a red signal light, a green signal light, and a controller connected to the proximity sensor and the red and green signal lights and the controller turns on the green signal light and turns off the red signal light when the proximity sensor indicates the absence of a train, and turns on the red signal light and turning off the green signal light when the train proximity sensor indicates the presence of a train. A light source, preferably an infrared light source, and a light detector, preferably an infrared light detector, are arranged to reflect and detect from a passing train to indicate its presence. An output connected to the train proximity sensor for producing an output signal when the sensor indicates the presence of a train, which output can be used for controlling a remote block signal. An input, responsive to a signal received from a remote sensor, controls the illumination of the red and green lights and synchronizes two block signals.

19 Claims, 3 Drawing Sheets

BLOCK SIGNAL AND TRAIN PROXIMITY DETECTOR

BACKGROUND OF THE INVENTION

This invention relates generally to accessories for toy or model railroad layouts and more particularly to an improved combination block signal and train detector for such layouts.

There is a demand for model railroad accessories that simulate signals used on full sized railroads. One such accessory is a block signal. A block signal controls the passage of trains by providing a red or green signal right to the engineer indicating whether it is safe to pass the block signal.

In full size trains, block signals are controlled by a variety of complex mechanisms the precise duplication of which is not practical in model train layouts. Accordingly, it has become common to provide block signals in model train layouts that turn red when a train approaches and turn green after the train has passed. Previously, known block signals have been relatively simple devices including a red light and a green light that can be selectively illuminated by applying appropriate activating signals to inputs of the block signal. The inputs to the block signals have come from a variety of sources generally referred to as train detectors. Known train detectors include detectors that use a section of isolated track that is responsive to a train passing over it and light or magnetic sensors to detect the presence of a passing train.

Heretofore, proving block signals responsive to the passage of trains has required the use of multiple devices and sometimes complex wiring connections between them. It is an object of this invention to provide a combination of a block signal and train detector that greatly simplifies installation compared with known approaches.

It is another object if this invention to provide a combination block signal and train detector that can be easily synchronized with similar devices positioned at remote locations on a model train.

It is another object of the invention to provide a combination block signal and train detector that uses simple inexpensive circuitry that allows the device to be manufactured and sold at reasonable prices

BRIEF DESCRIPTION OF THE INVENTION

Briefly stated, and in accordance with a presently preferred embodiment of the invention, a combination model train sensor and block signal includes a train proximity sensor, a red signal light, a green signal light, and a controller connected to the proximity sensor and the red and green signal lights. The controller turns on the green signal light and turns off the red signal light when the proximity sensor indicates the absence of a train, and turns on the red signal light and turning off the green signal light when the train proximity sensor indicates the presence of a train.

In accordance with another aspect of the invention, the train proximity sensor of the model train sensor and block signal includes a light source, preferably an infrared light source, and a light detector, preferably an infrared light detector, arranged to reflect and detect from a passing train to indicate its presence.

In accordance with another aspect of the invention, the combination model train sensor and block signal includes an output connected to the train proximity sensor for producing an output signal when the sensor indicates the presence of a train, which output can be used for controlling a remote block signal.

In accordance with another aspect of the invention, the combination model train sensor and block signal includes an input, responsive to a signal received from a remote sensor, for controlling the illumination of the red and green lights and synchronizing two block signals.

In accordance with another aspect of the invention, the combination model train sensor and block signal includes a combination input/output connected to the controller, the input/output producing a train present signal when the train proximity sensor indicates the presence of a train and being responsive to an externally applied train present signal for turning the red light on and the green light off even when the local train proximity sensor indicates the absence of a train.

In accordance with another aspect of the invention, the combination model train sensor and block signal includes a first transistor switch for turning on the green light, the first transistor switch preferably connected to be normally on and a second transistor switch having an input connected to the train proximity sensor and an output connected to the red signal light and to an input of the first transistor switch to turn the red signal light on and apply an off signal to the input of the first transistor switch to turn the green signal off. The second transistor switch is preferably connected to be normally off.

In accordance with another aspect of the invention, the input/output is connected to the second transistor switch.

The novel aspects of the invention are set forth with particularity in the appended claims. The invention itself together with further objects and advantages thereof may be more readily understood by reference to the following detailed description of a presently preferred embodiment of the invention taken in conjunction with the accompanying drawing in which:

DETAILED DESCRIPTION OF THE INVENTION

Figure 1:
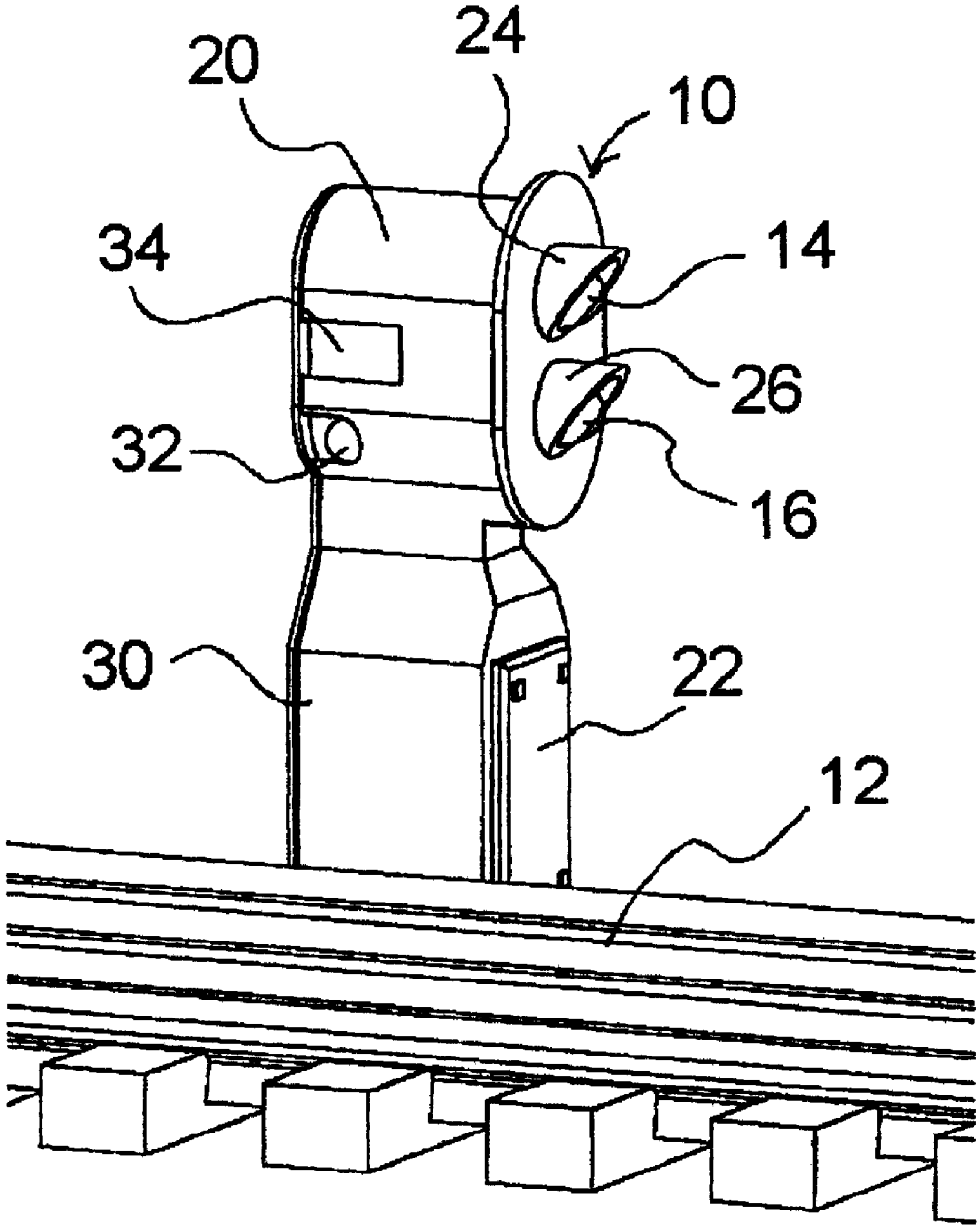
FIG. 1 is a diagrammatic view of a combination model train sensor and block signal disposed at a track side location.

Referring now to FIG. 1, a combination model railroad detector and block signal in accordance with this invention is illustrated in a diagrammatic form. For convenience, we will refer to the combination model train sensor and block signal as a block signal detector even though that language is slightly incongruous. The block signal detector indicated generally at 10 is positioned closely adjacent a section of a model railroad track 12. Preferably, the signal is positioned within in about ½" of the track to ensure reliable train detection.

The block signal detector 10 includes a red signal light 14 and a green signal light 16 arranged in the upper portion of a housing 20 that is configured to look like an actual block signal, of the type used on a full sized railroad. To that end, a simulated access door 22 is provided in the lower portion of the signal and the signal lights 14 and 16 are arranged in a conventional top and bottom configuration. Preferably, light hoods 24 and 26 surround the lights to make the signal lights visible in bright sun. Preferably, the block signal detector is formed of relatively high impact plastic to provide a durable but low cost construction. The plastic housing can be injection molded to produce a pleasing appearance at low cost. The internal components of the housing are mounted on a printed circuit board that is actually accessed through a rear cover plate 30 rather than simulated access door 22.

Preferably, an infrared light source 32 is mounted on the printed circuit board (not visible in this figure) and extends through an opening in housing 20. A preferably infrared sensor 34 is mounted in relatively close proximity to infrared source 32 but the source and detector are arranged so that the detector is not responsive to light emitted directly from the source but is responsive only to a light reflected from a passing model train. An internal light barrier between the source and the detector may also be used.

Figure 2:
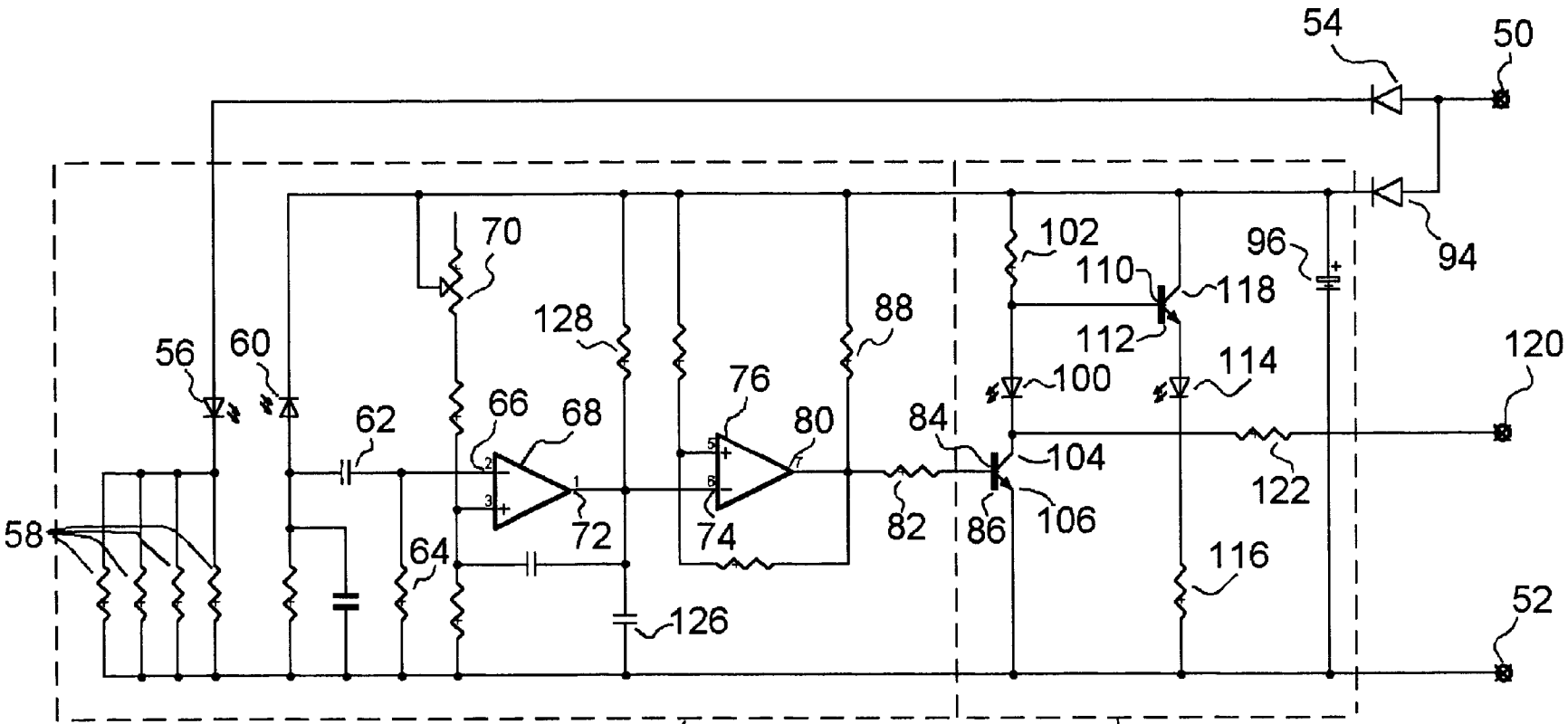
FIG. 2 is a schematic diagram of a combination model train detector and block signal in accordance with this invention.

The operation of the block signal detector will now be described in conjunction with the schematic diagram of a presently preferred embodiment thereof shown in FIG. 2.

The block signal detector circuitry is designed to be powered from a 12–14 volt AC source sometimes referred to as a transformer, of the type used to provide power to the engines and accessories of model trains. Power input terminal 50 is adapted to be connected to the AC power source and a common terminal 52 which for convenience may be referred occasionally herein as a ground terminal even though is it is not in fact grounded, is adapted to be connected to the opposite side of the power source. A rectifier diode 54 is connected between the power input terminal 50 and a light emitting diode 56 which is preferably an infrared light emitting diode. Current limiting resistors 58 adjust the current through infrared emitting diode 56 to a level that balances long diode life with sufficient light output to reliably detect the presence of trains.

The arrangement just described produces a stream of light pulses having a repetition rate of approximately 60 hertz from infrared emitting diode 56, rather than a constant beam. An infrared detector 60 is connected to an inverting input 66 of an operational amplifier 68. Operational amplifier 68 is preferably ½ of an LM393M dual operation amplifier. A high pass filter, including a capacitor 62 and a resistor 64 is connected between the output of infrared detector 60 and an input 66 of an amplifier 68 to substantially eliminate false triggering caused by constant ambient light. This permits the sensitivity of operational amplifier 68 to be set relatively high for reliable train detection without increasing false triggering from ambient light. The sensitivity of the operational amplifier 68 is set by a variable resistor 70. The remaining components associated with operational amplifier 68 are conventional and will be readily understood by those skilled in the art.

An output 72 of an amplifier 68 is connected to an inverting input 74 of a second operational amplifier 76 configured as an inverter to correct the sense of the output signal for operating the controller of the block signal detector. The output terminal 80 of the amplifier 76 is connected through a resistor 82 to the base 84 of a transistor 86. Base 84 is normally held high by resistors 88 and 82 so that the transistor is normally on. Output 80 pulls base 84 essentially to ground through resistor 82 when a train is present as indicated by a reflected infrared light at detector 60. The portion of the block signal detector just described is indicated in phantom lines in FIG. 2 as train proximity detector 90. The remaining portion of the circuit, indicated in phantom as 92, is referred to as the controller. A second rectifier diode 94 provides power to controller 92 and proximitor sensor 90. A filter capacitor 96 smoothes the output of rectifier diode 94 to provide relatively steady DC output for the red and green signal lights.

Referring back to FIG. 2, a red signal light 100, preferably a red light emitting diode, is connected in series with a collector load resistor 102 between a collector 104 of transistor 86 and the positive voltage source. An emitter 106 of transistor 86 is connected to common. Normally, transistor 86 is held off by inverter amplifier 76 and red light emitting diode 100 is extinguished. As long as transistor 86 is off, base 110 of transistor 112 is held high by resistor 102 thereby turning transistor 112 on and allowing current to flow through the green signal light 114 which is preferably a green light emitting diode, and then through a collector resistor 116 which sets the current through a light emitting diode 114. The collector 118 of transistor 112 is connected to the positive voltage source.

When a train is detected, the signal applied to the base 84 of transistor 86 goes high turning transistor 86 on. The voltage at base 110 of transistor 112 is pulled low to a voltage of approximately equal to the saturation voltage of transistor 86 plus the voltage drop of light emitting diode 100, the sum of which is approximately 1.7 volt which turns transistor 112 off and extinguishes light emitting diode 114.

In accordance with a presently preferred embodiment of the invention a time delay is provided so that the red signal lamp remains illuminated and the greed signal lamp remains extinguished for a pre-selected time after the proximity detector has detected the passage of a train. Time delay capacitor 126 is connected the output 72 of amplifier 68 and ground. The time constant set by capacitor 126 and resistor 128 connected in series therewith, sets the predetermined time. Preferably, a time of about 2 seconds is provided.

In accordance with the preferred embodiment of the invention, an input/output terminal 20 is provided. Input/output terminal 120 is connected to collector 104 of transistor 86 through a small isolation resistor 122. It will be appreciated that when a train is detected by the proximity detector 90 and transistor 86 is turned on, the input/output terminal 120 is pulled low through resistor 122. When no train is present and transistor 86 is off, the input/output terminal 120 is high.

If a low or ground remote signal is connected to input/output terminal 120 it will be appreciated that the collector 104 of transistor 86 will be pulled low whether transistor 86 is turned on or off by proximity detector 90. Since transistor 86 is normally off in the absence of a train, it will be seen that a remote train present signal applied to input/output terminal 120 will turn red signal light 100 on and turn green signal light 114 off. This allows two block signal detectors in accordance with the invention to be synchronized so that when one detects the presence of a train, the light in the other will also turn from green to red. The synchronization is bi-directional and the wiring is exceeding simple as will be seen by reference to FIG. 3.

Figure 3:
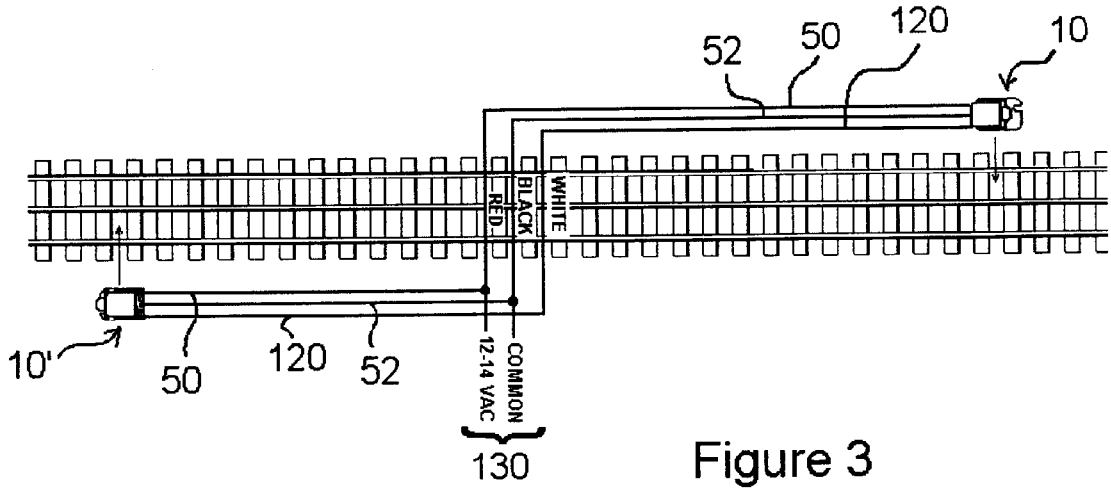
FIG. 3 is a diagrammatic view showing two combination model train detectors and block signals connected together for synchronized operation in accordance with the invention.

FIG. 3 shows a pair of block signal detectors 10 and 10' interconnected for synchronized operation. Terminals 50, 52 and 120 of first block signal detector 10 are connected to the like numbered terminals of the second block signal detector 10'. A power source of 12–14 volts AC is connected between terminals 50 and 52 of the two block signal detectors respectively as shown at 130. It will appreciated that if for example a train approaches from the left as the Figure would normally be viewed, block signal detector 10' will detect the proximity of the train and the red signal lamp will be illuminated and the green signal lamp extinguished. Simultaneously, input/output 120 of block signal 10 will be driven low thereby illuminating the red signal lamp and extinguishing the green signal lamp of block signal detector 10 even though no train is detected by the proximity detector of block signal detector 10. Similarly, if a train approaches from the right, the detectors in block signal detector 10 will sense the proximity of the train and illuminate the red signal light and extinguish the green signal light of both of the block signal detectors 10 and 10'.

While the invention has been described in connection with the presently preferred embodiment thereof, those skilled in the art will recognize that a number of modifications and changes may be made therein without departing from the true spirit and scope of the invention which accordingly is intended to be defined solely by the appended claims:

What is claimed:

1. A combination model train sensor and block signal comprising:

a model train proximity sensor;

a model train red signal light;

a model train green signal light;

a controller connected to model the train proximity sensor, the red signal light and the green signal light, said controller turning on the green signal light and turning off the red signal light when the train proximity sensor indicates the absence of a train and turning on the red signal light and turning off the green signal light when the train proximity sensor indicates the presence of a train.

2. The combination model train sensor and block signal of claim 1 comprising an output connected to the train proximity sensor producing an output signal when the train proximity sensor indicates the presence of a train.

3. The combination model train sensor and block signal of claim 1 comprising a remote input connected to the controller responsive to a remote signal to turn on the green signal light and turn off the red signal light when the remote signal indicates the absence of a train and turn on the red signal light and turn off the green signal light when the remote signal indicates the presence of a train.

4. The combination model train sensor and block signal of claim 1 comprising an input/output connected to the controller for synchronizing the illumination of the red light and the green light with a remote signal.

5. The combination model train sensor and block signal of claim 4 in which the input/output produces a train present signal when the train proximity sensor indicates the presence of a train.

6. The combination model train sensor and block signal of claim 5 in which the controller is responsive to a train present signal applied to the input/output to turn on the red signal light and turn off the green signal light, even when the train proximity sensor indicates the absence of a train.

7. The combination model train sensor and block signal of claim 1 comprising a delay circuit connected between the train proximity sensor and the control circuit for continuing to apply a train present signal to the controller for a predetermined time after the train proximity sensor indicates that a train is no longer present.

8. A combination model train sensor and block signal comprising:

a model train proximity sensor including a light source and a light detector arranged to detect light from the light source only when reflected by an object;

a model train red signal light;

a model train green signal light;

a controller connected to the model train proximity sensor, the red signal light and the green signal light, said controller turning on the green signal light and turning off the red signal light when the train proximity sensor indicates the absence of a train and turning on the red signal light and turning off the green signal light when the train proximity sensor indicated the presence of a train.

9. The combination model train sensor and block signal of claim 8 in which the light source is an infrared light source, and the light detector is an infrared light detector.

10. A combination model train sensor and block signal comprising:

a model train proximity sensor;

a model train red signal light;

a model train green signal light;

a controller connected to the train proximity sensor, the red signal light and the green signal light, said controller comprising a first transistor switch for turning on the green signal light, the first transistor switch connected to be normally on; and a second transistor switch having an input connected to the train proximity sensor, and an output connected to the red signal light and to an input of the first transistor switch to turn the red signal light on, and apply an off signal to the input of the first transistor switch to turn the green signal light off when the train proximity sensor indicates the presence of a train.

11. The combination model train sensor and block signal of claim 10 comprising an input/output connected to the controller for synchronizing the illumination of the red light and the green light with a remote signal.

12. The combination model train sensor and block signal of claim 11 in which the input/output is connected to the output of the second transistor switch.

13. The combination model train sensor and block signal of claim 11 in which the input/output is connected to the output of the second transistor switch and to the input of the first transistor switch.

14. The combination model train sensor and block signal of claim 10 in which the red signal light is connected to the collector of the second transistor switch, and the green signal light is connected to the emitter of the first transistor switch.

15. The combination model train sensor and block signal of claim 14 in which the red signal light is connected to the base of the first transistor switch.

16. The combination model train sensor and block signal of claim 15 comprising a collector resistor connected from a voltage source to the red signal light and the base of the first transistor switch.

17. The combination model train sensor and block signal of claim 16 in which the emitter of the second transistor switch is connected to ground.

18. The combination model train sensor and block signal of claim 17 in which the collector of the first transistor switch is connected to the voltage source.

19. The combination model train sensor and block signal of claim 18 in which an input/output is connected to the collector of the second transistor switch.

* * * * *